US011262102B2

(12) United States Patent
Aycock

(10) Patent No.: US 11,262,102 B2
(45) Date of Patent: Mar. 1, 2022

(54) VENT PROVING SYSTEM

(71) Applicant: Field Controls, LLC., Kinston, NY (US)

(72) Inventor: James L. Aycock, Kinston, NY (US)

(73) Assignee: FIELD CONTROLS, LLC, Kinston, NC (US)

( * ) Notice: Subject to any disclaimer, the term of this patent is extended or adjusted under 35 U.S.C. 154(b) by 0 days.

(21) Appl. No.: 16/523,534

(22) Filed: Jul. 26, 2019

(65) Prior Publication Data

US 2019/0346176 A1 Nov. 14, 2019

Related U.S. Application Data

(63) Continuation of application No. 15/965,341, filed on Apr. 27, 2018, now Pat. No. 10,386,093, which is a continuation of application No. 12/947,392, filed on Nov. 16, 2010, now Pat. No. 9,958,184.

(60) Provisional application No. 61/281,364, filed on Nov. 16, 2009.

(51) Int. Cl.

| | |
|---|---|
| ***F24H 9/20*** | (2006.01) |
| ***F23L 11/00*** | (2006.01) |
| ***F23N 5/24*** | (2006.01) |

(52) U.S. Cl.

CPC ..... *F24H 9/2042* (2013.01); *F23L 11/005* (2013.01); *F23N 5/245* (2013.01)

(58) Field of Classification Search

CPC ..... F24H 9/2042

See application file for complete search history.

(56) References Cited

U.S. PATENT DOCUMENTS

| | | | | |
|---|---|---|---|---|
| 2,185,786 | A * | 1/1940 | Eaton | F22B 1/30 392/326 |
| 2,698,140 | A * | 12/1954 | Buechler | F24H 9/2007 236/9 R |
| 3,934,796 | A | 1/1976 | Smith, Jr. et al. | |
| 4,046,318 | A * | 9/1977 | Ripley | F23L 11/005 236/1 G |
| 4,189,296 | A * | 2/1980 | Hayes | F23N 5/20 431/20 |
| 4,254,759 | A | 3/1981 | Schmidt | |
| 4,299,554 | A | 11/1981 | Williams | |
| 4,401,425 | A | 8/1983 | Gable et al. | |
| 4,406,396 | A | 9/1983 | Habegger | |

(Continued)

OTHER PUBLICATIONS

Office Action dated Jul. 2, 2013 for Canadian Patent Application 2,757,724, (3 pp.).

(Continued)

*Primary Examiner* — Nathaniel Herzfeld

(74) *Attorney, Agent, or Firm* — Crowell & Moring LLP

(57) ABSTRACT

A vent proving system is described for use with a gas fired appliance. The gas fired appliance includes a gas burner, a vent damper for selectively opening or closing an exhaust vent from the gas fired appliance and a relay control for operatively controlling the vent damper and the gas burner to open the damper if the gas burner is on. The vent proving system comprises a sensor for sensing a variable in the vent representing air flow direction in the vent. An electrical switch is connected in series between the relay control and the vent damper. A controller is operatively connected to the sensor, the electrical switch and to the relay control.

8 Claims, 7 Drawing Sheets

(56) References Cited

U.S. PATENT DOCUMENTS

| | | | | |
|---|---|---|---|---|
| 4,751,912 | A | 6/1988 | Monette | |
| 4,920,866 | A | 5/1990 | Hoban | |
| 5,039,006 | A * | 8/1991 | Habegger | F24D 19/1084 236/11 |
| 5,082,173 | A | 1/1992 | Poehlman et al. | |
| 5,158,446 | A * | 10/1992 | Hall | F23L 17/005 431/20 |
| 5,423,479 | A | 6/1995 | Nichols | |
| 5,531,214 | A | 7/1996 | Cheek | |
| 5,567,143 | A | 10/1996 | Servidio | |
| 5,920,488 | A | 7/1999 | Arnold et al. | |
| 6,208,263 | B1 | 3/2001 | Strand | |
| 6,227,961 | B1 | 5/2001 | Moore et al. | |
| 6,254,008 | B1 | 7/2001 | Erickson et al. | |
| 6,261,087 | B1 | 7/2001 | Bird et al. | |
| 6,373,376 | B1 | 4/2002 | Adams et al. | |
| 6,409,143 | B1 | 6/2002 | Beck et al. | |
| 6,448,901 | B1 | 9/2002 | Adams et al. | |
| 6,595,430 | B1 | 7/2003 | Shah | |
| 6,672,255 | B1 | 1/2004 | Zayas | |
| 6,766,771 | B1 | 7/2004 | Hotton | |
| 6,879,239 | B2 | 4/2005 | McCarren | |
| 6,993,417 | B2 | 1/2006 | Osann, Jr. | |
| 7,181,317 | B2 | 2/2007 | Amundson et al. | |
| D546,435 | S | 7/2007 | Guzorek | |
| 7,250,870 | B1 | 7/2007 | Viner et al. | |
| D562,261 | S | 2/2008 | Takach et al. | |
| D562,262 | S | 2/2008 | Takach et al. | |
| D563,325 | S | 3/2008 | Takach et al. | |
| D570,791 | S | 6/2008 | Takach et al. | |
| D579,096 | S | 10/2008 | Guzorek | |
| 7,496,627 | B2 | 2/2009 | Moorer et al. | |
| 7,584,897 | B2 | 9/2009 | Schultz et al. | |
| 2004/0216765 | A1 | 11/2004 | Frenette | |
| 2005/0162109 | A1 * | 7/2005 | Randals | F23N 5/00 318/269 |
| 2006/0049268 | A1 | 3/2006 | Weimer et al. | |
| 2007/0229293 | A1 | 10/2007 | Martino | |
| 2008/0048853 | A1 | 2/2008 | Leach et al. | |
| 2008/0082234 | A1 | 4/2008 | Majersik et al. | |
| 2008/0127963 | A1 | 6/2008 | Thompson | |
| 2012/0282557 | A1 | 11/2012 | Hokanson | |

OTHER PUBLICATIONS

Response to Office Action filed Dec. 30, 2013 for Canadian Patent Application 2,757,724 (10 pp.).

Notice of Allowance for Canadian Patent Application 2,757,724 dated Mar. 14, 2014, (1 pg.).

"Honeywell Product Data," L8148A,E,J Aquastat® Relays, 60-2278-9, G.R. Rev. Dec. 2001, (12 pp.).

* cited by examiner

VENT PROVING SYSTEM

CROSS-REFERENCE TO RELATED APPLICATIONS

This application is a continuation of U.S. patent application Ser. No. 15/965,341, filed Apr. 27, 2018, which is a continuation of U.S. patent application Ser. No. 12/947,392, filed Nov. 16, 2010, now U.S. Pat. No. 9,958,184 issued May 1, 2018, and claims the benefit of U.S. Provisional Application No. 61/281,364, filed Nov. 16, 2009. The applications in this paragraph are hereby incorporated by reference in their entireties.

TECHNICAL FIELD

This invention relates to gas fired appliances and, more particularly, to a vent proving system for use with a gas fired appliance.

BACKGROUND

A typical gas fired appliance, such as a boiler, includes a gas burner for generating heat. For example, with a boiler the burner is used for heating water. The appliance typically includes a draft hood or diverter. A vent from the draft hood exhausts products of combustion from the appliance. The vent may include a vent damper.

A typical gas fired appliance, in one known form, includes a relay control for operatively controlling the vent damper and the gas burner to open the damper if the gas burner is on. For example, when heat is called for the relay control sends a control signal to the vent damper to open the damper. Once the damper is open, then a signal is returned to the gas fired appliance to ignite the gas burner. Once sensed temperature exceeds the setpoint, then the control signal to the damper is terminated, causing the damper to close and removing the signal via the vent damper to the gas valve or burner control, causing it to shut off the gas supply to the burner. Closing the damper retains latent heat.

With current construction techniques, it is common for homes to be sealed tighter to provide fewer air flow paths between the homes' interior and exterior. This can result in depressurization of the home, or other building. Particularly, if other exhausting appliances such as a clothes dryer or exhaust fans are being used, then air is being drawn out of the house so that the home may become depressurized as there is no makeup air. When a building is depressurized, it will try to equalize by drawing in air from any openings to the outside including the gas fired appliance's venting system. This can result in the appliance's products of combustion spilling into the home. Some appliances, such as boilers, are equipped with a thermal switch to shut the boiler off if it is not drafting properly due to a blocked vent. However, this switch may not shut the boiler off if it is not drafting properly due to back drafting caused by cold air entering the home through the vent.

The present invention is directed to solving one or more of the problems discussed above, in a novel and simple manner.

BRIEF SUMMARY

In accordance with the invention, there is provided a vent proving system to monitor vent gas temperature of a gas fired appliance to ensure that the appliance is venting properly.

Broadly, there is disclosed in accordance with one aspect of the invention a vent proving system for use with a gas fired appliance. The gas fired appliance includes a gas burner and a relay control for operatively controlling the gas burner. The vent proving system comprises a sensor for sensing a variable in the vent representing air flow direction in the vent. An electrical switch is connected to the relay control. A controller is operatively connected to the sensor, the electrical switch and to the relay control. The controller determines if a back draft condition is present in the vent when the gas burner is on and selectively operates the electrical switch to signal the relay control if a back draft condition is present in the vent when the gas burner is on.

There is disclosed in accordance with another aspect of the invention a vent proving system for use with a gas fired appliance. The gas fired appliance includes a gas burner, a vent damper for selectively opening or closing an exhaust vent from the gas fired appliance and a relay control for operatively controlling the vent damper and the gas burner to open the damper when the gas burner is on. The vent proving system comprises a sensor for sensing a variable in the vent representing air flow direction in the vent. An electrical switch is connected in series between the relay control and the vent damper. A controller is operatively connected to the sensor, the electrical switch and to the relay control. The controller determines if a back draft condition is present in the vent when the gas burner is on and selectively operates the electrical switch to open the connection between the relay control and the vent damper if a back draft condition is present in the vent when the gas burner is on.

It is a feature of the invention that the sensor senses vent temperature. The sensor may comprise a thermostat.

It is another feature of the invention that the electrical switch comprises a relay operated by the controller and having a contact in series between the relay control and the vent damper. The relay may comprise a first relay and a second relay may be operated by the controller and having a second relay contact in series with the first relay contact between the relay control and the vent damper for redundancy.

It is still another feature of the invention that the controller includes a timer for operating the electrical switch to close the connection between the relay control and the vent damper for a select time after the relay control ignites the gas burner and after the select time operating the electrical switch to open the connection between the relay control and the vent damper if a back draft condition is present in the vent when the gas burner is on.

It is yet another feature of the invention to provide an indicator to indicate if a back draft condition has been sensed.

It is still another feature of the invention that the controller includes a timer for disabling operation of the electrical switch after a back draft condition has been sensed.

It is still another feature of the invention that the controller includes a timer for retrying operation of the electrical switch after a back draft condition has been sensed to determine if the back draft condition has been corrected.

It is yet another feature of the invention that vent proving system is integral with the vent damper and comprising a duct mounting the vent damper and the sensor.

There is disclosed in accordance with another aspect of the invention a vent proving system comprising a housing for mounting to the vent. A control board in the housing includes a first connection means for connection to the gas fired appliance and a second connection means for connection to the vent damper. A thermostat is secured to the housing and includes a sensing probe protruding into the vent for sensing temperature in the vent. An electrical switch in the housing is connected between the first connection means and a second connection means for connection in series between the relay control and the vent damper. A controller on the control board is operatively connected to the sensor, the electrical switch and to the first connection means and the second connection means. The controller determines if a back draft condition is present in the vent when the gas burner is on and selectively operates the electrical switch to open the connection between the relay control and the vent damper if a back draft condition is present in the vent when the gas burner is on.

Further features of the invention will be readily apparent from the specification and from the drawings.

DETAILED DESCRIPTION

Figure 1:
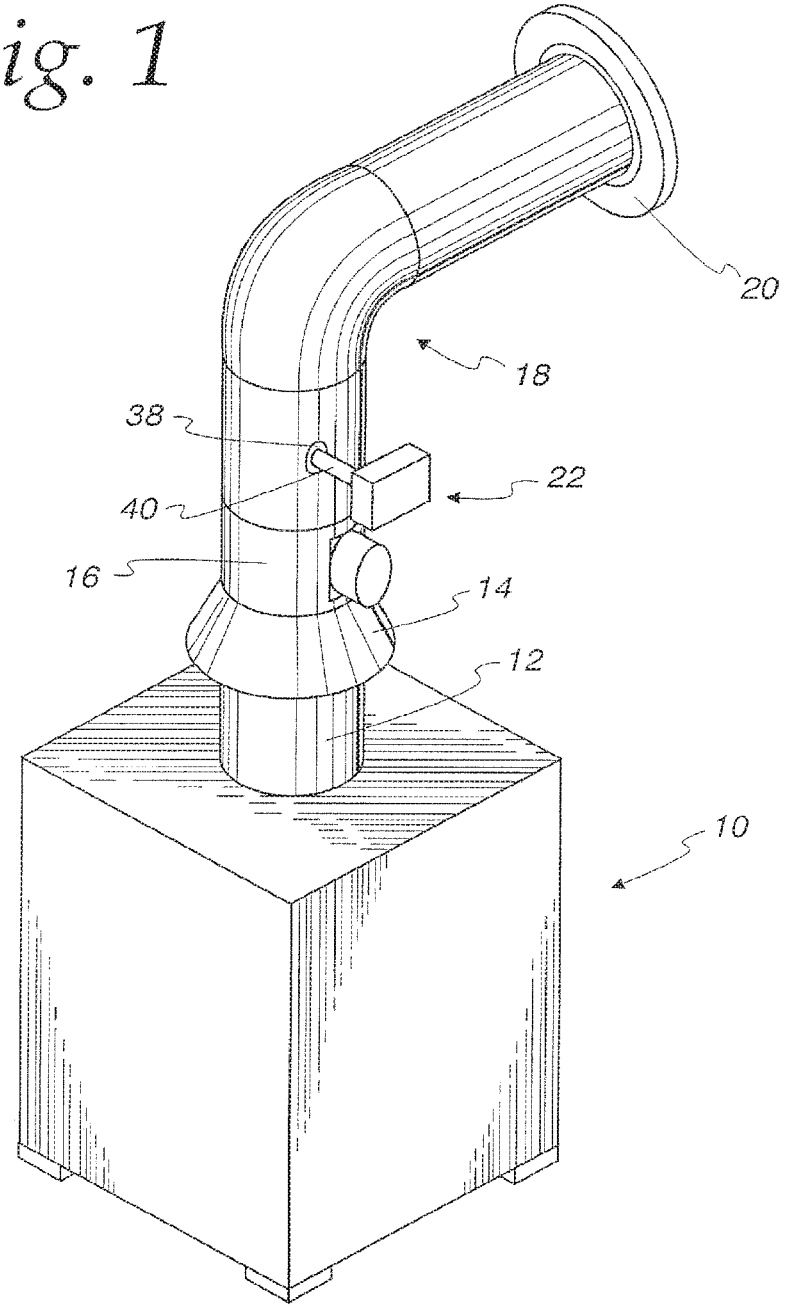
FIG. 1 is a perspective view of a vent proving system in accordance with the invention mounted to a gas fired appliance.

Referring to FIG. 1, a gas fired appliance 10 of conventional construction is illustrated. The gas fired appliance 10 may comprise, for example, a boiler. For simplicity herein, the gas fired appliance 10 will be referred to as a boiler, it being understood that the invention is not limited to use in connection with a boiler. The boiler 10 includes an exhaust pipe 12 connected to a draft hood 14. A vent damper 16 may be connected to the draft hood 14 and is in turn connected to a vent pipe or stack 18 through a wall opening 20 to exhaust products of combustion from the boiler 10 to the exterior of the building. Again, for simplicity herein, the ducts and/or pipes used in venting from the boiler 10 will be referred to as a "vent". The present invention is not directed to any particular gas fired appliance or configuration of the venting system. In accordance with the invention, a vent proving system 22 is installed on the vent 18 downstream of the vent damper 16. As described below, the vent proving system 22 may be used in installations that do not include the vent damper 16.

Figure 2:
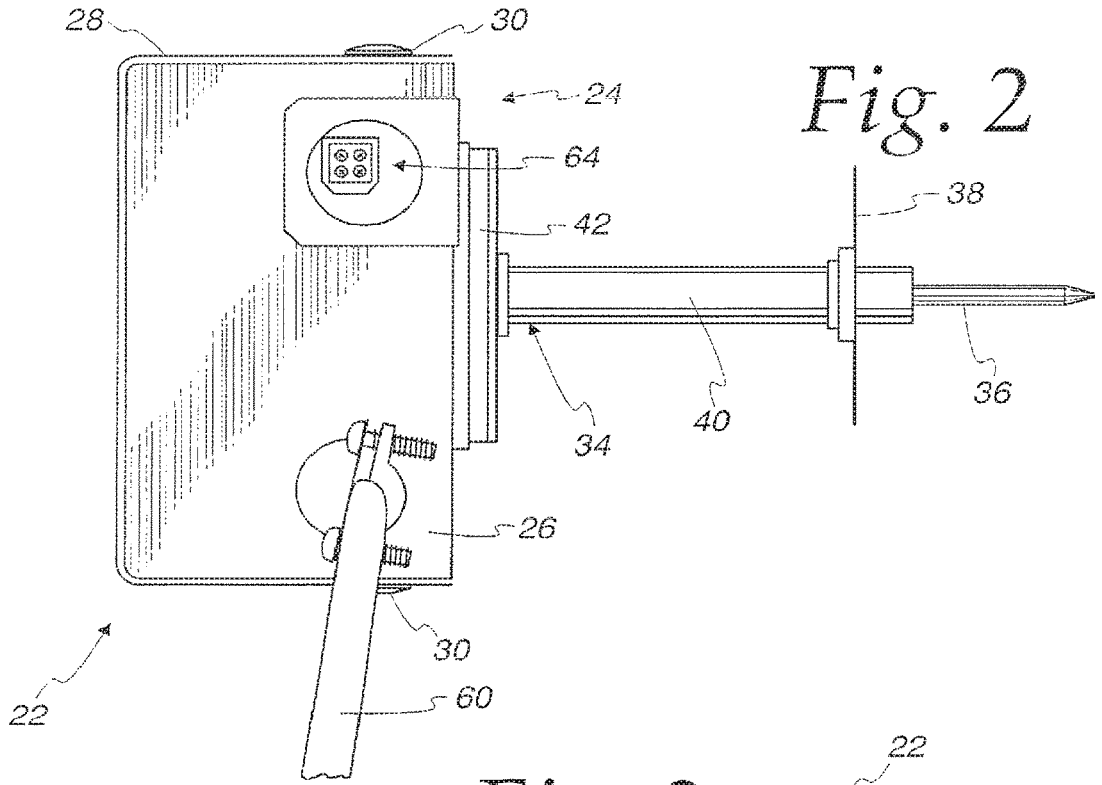
FIG. 2 is a side elevation view of the vent proving system in accordance with the invention.
Figure 3:
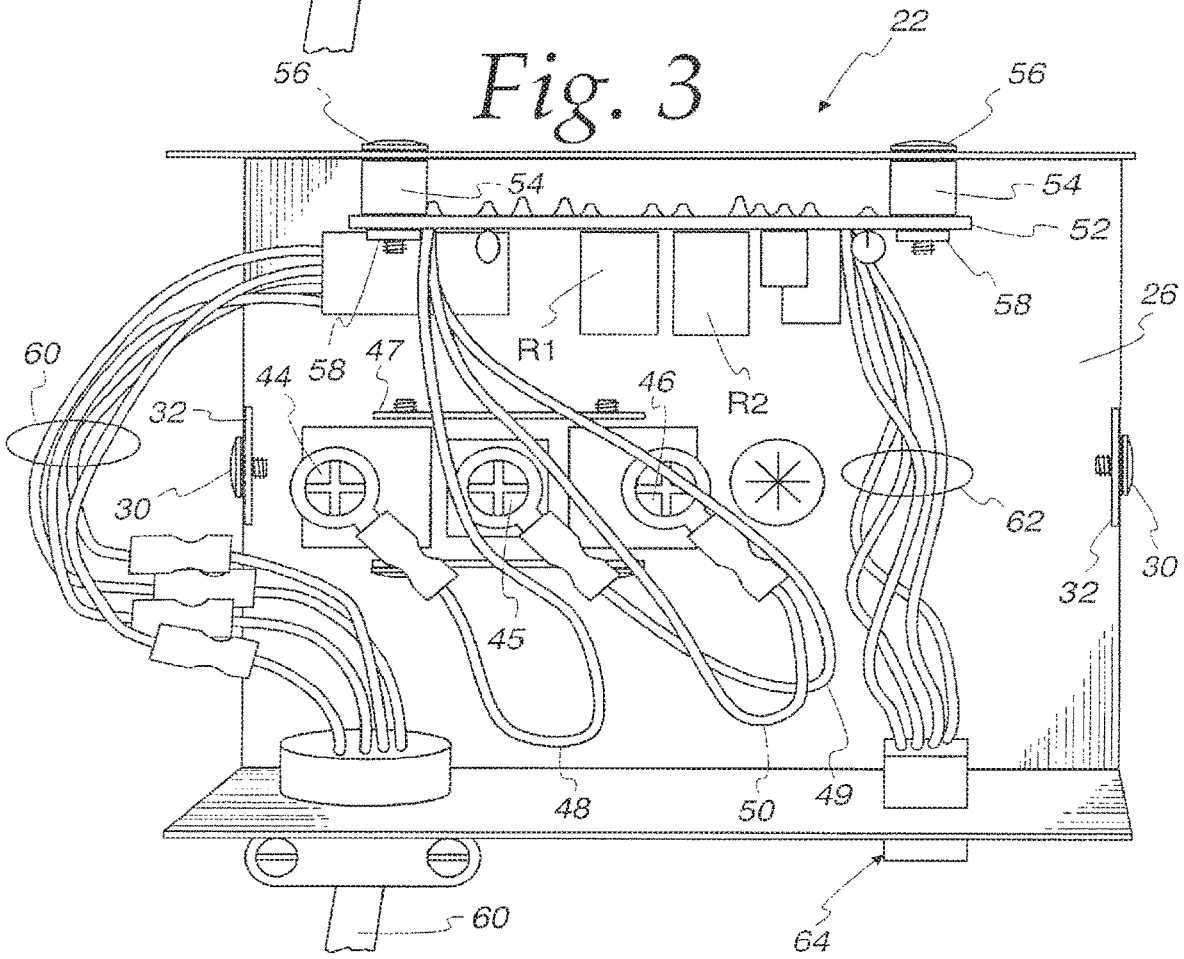
FIG. 3 is a front elevation view of the vent proving control of FIG. 2 with a cover removed.

Referring to FIGS. 2 and 3, the vent proving system 22 is illustrated. The vent proving system 22 comprises a housing 24 including a base 26 and a removable cover 28. The vent proving system 22 is shown with the cover 28 removed in FIG. 3. A pair of screws 30 thread into tabs 32 on opposite sides of the base 26 for securing the cover 28 thereto. A temperature sensor in the form of a thermostat 34 is secured to the base 26 and extends rearwardly therefrom, as shown in FIG. 2. As will be apparent, a thermocouple or thermistor could also be used as a temperature sensor. The thermostat 34 includes a probe 36 protruding into the vent 18 incident to the vent proving system 22 being mounted to the vent 18 using a flange 38, as shown in FIG. 1. A stalk 40 extends between the flange 38 and a mount 42 and houses the probe 36. The mount 42 is secured to the base 26 in a conventional manner, not shown. The thermostat 34 includes switch contacts, shown schematically in FIG. 5, connected to terminals 44, 45 and 46 secured to the base 26, as shown in FIG. 3, using a bracket 47. Wires 48, 49 and 50 connect the respective terminals 44-46 to a control board 52. The control board 52 is mounted to the base 26 using standoffs 54, screws 56 and nuts 58. A first cable 60 comprises four conductors for electrically connecting circuitry on the control board 52 to a relay control, as described below. A second cable 62 comprises four conductors likewise connected between circuitry on the control board 52 and an electrical connector 64 secured to the base 26. The connector 64 is provided for connection to a cable from the vent damper 16, as discussed below.

Figure 4:
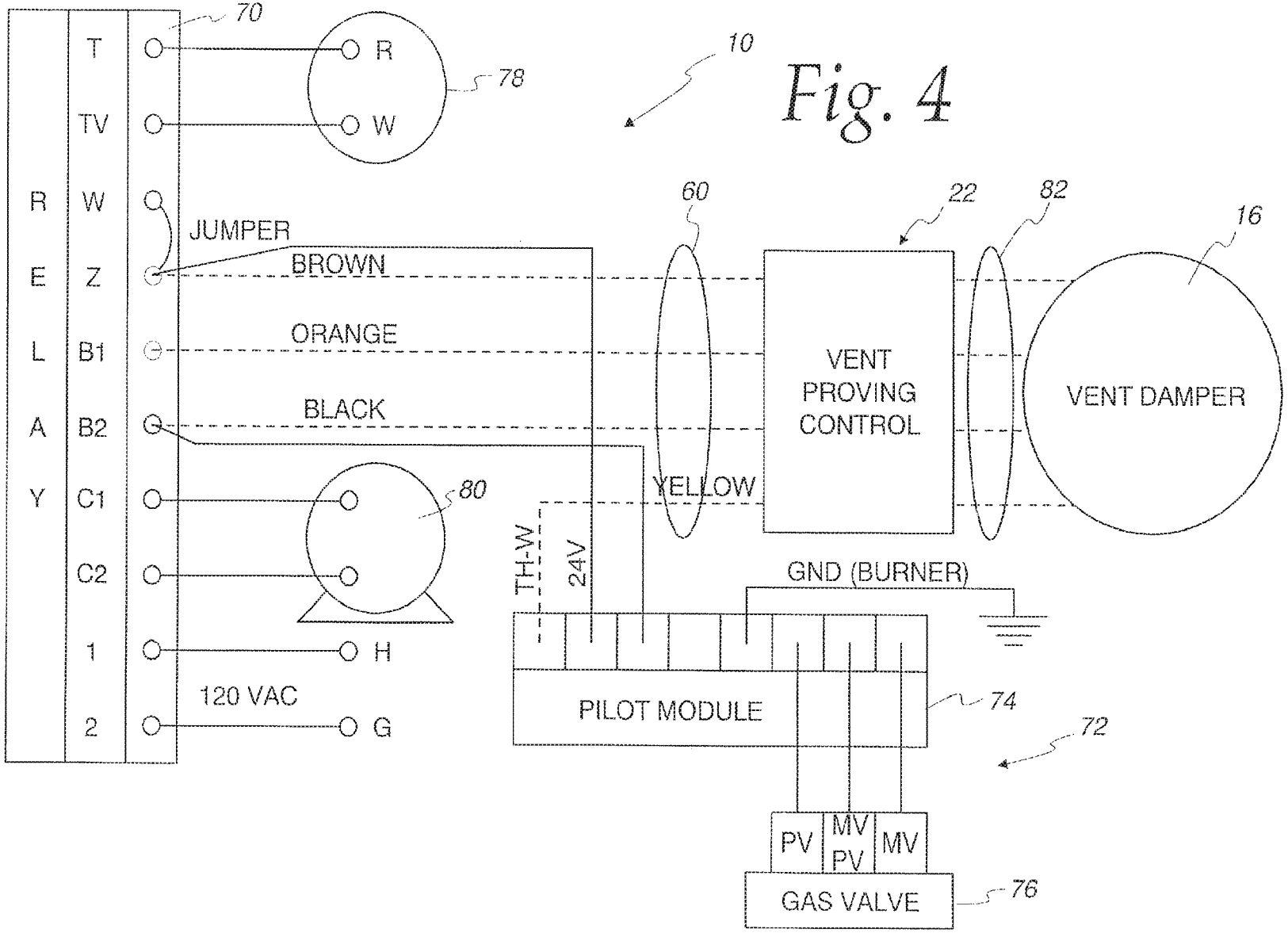
FIG. 4 is a block diagram of a control system for the gas fired appliance of FIG. 1.

Referring to FIG. 4, a block diagram of the boiler 10 and vent proving system 22 is illustrated.

The boiler 10 includes a relay control 70 for controlling the vent damper 16 and a gas burner 72. In an exemplary embodiment of the invention, the vent proving system 22 is described for use in connection with the relay control 70 in the form of an Aquastat® L8148-E relay. Aquastat® is a registered trademark of Honeywell. The termination points for the relay control 70 are as set forth in specifications for the Honeywell Aquastat® L8148-E relay. Likewise, in the exemplary embodiment to the invention, the vent damper 16 may comprise a GVD-series vent damper from Field Controls. The gas burner 72 comprises a pilot module 74, such as a Honeywell S8160 Series, and a gas valve 76.

In accordance with a typical application for an Aquastat® L8148-E relay, a room thermostat 78 is connected to T and TV terminals of the relay control 70. A circulating pump 80 is connected to C1 and C2 terminals. 120 volt AC power is connected to terminals 1 and 2 of the relay control 70. In such a typical application, without the vent proving system 22, the Z, B1 and B2 terminals of the relay control 70 would be connected to a cable 82 from the vent damper 16 via brown, orange and black conducting lines, respectively. The brown line carries 24V power and the black line is a common. The orange line carries a 24V command signal used when heat is called for. The cable 82 also includes a yellow line to be connected to a TH-W input of the pilot module 74. The yellow line carries a 24V return signal from the damper 16 to ignite the gas burner 72. The Z and B2 terminals of the relay control 70 are also connected to the pilot module 74 to provide power.

In accordance with the invention, the vent proving system 22 is connected between the relay control 70 and the vent damper 16. Particularly, the vent damper cable 82 is connected to the vent proving system connector 64 and the vent proving system cable 60 is in turn connected to a suitable connector 84, see FIG. 5, to provide the indicated connections to the relay control 70 and pilot module 74.

Figure 5:
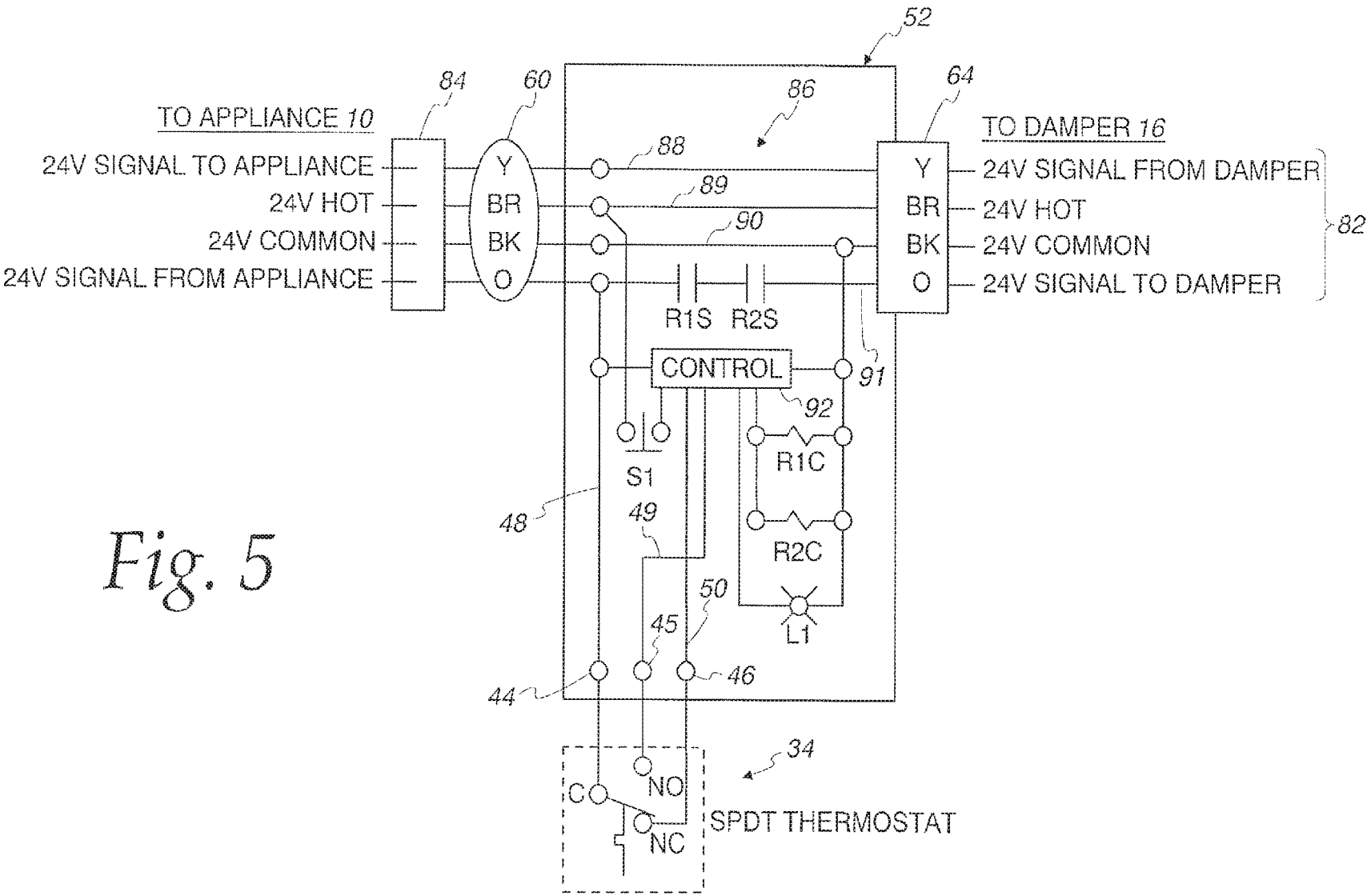
FIG. 5 is a detailed block diagram for the vent proving system of FIG. 2.

Referring to FIG. 5, a block diagram for circuitry of a controller 86, on the control board 52 of the vent proving system 22, is illustrated. The controller 86 includes conductors 88, 89 and 90 for directly connecting the yellow, brown and black lines from the cable 60 to the connector 64. The first conductor 88 is also referred to as the yellow line or return line. The second conductor 89 is also referred to as the brown line or power line. The third conductor 90 is also referred to as the black line or common line. Finally, a conductor 91 for connecting the orange line from the cable 60 to the connector 64 is also referred to as the orange line or command line. The control board 52, see FIG. 3, includes first and second control relays R1 and R2. As is conventional, each relay R1 and R2 includes a coil and switch contact. The coil is indicated with a suffix C while the switch contact is indicated with a suffix S, see FIG. 5. First and second relay contacts R1S and R2S are connected in series in the orange line 91. The orange line 91 carries a 24 volt command signal from the relay control 70 when heat is called for, while the yellow line 88 carries a 24 volt return signal from the damper 16 when the damper has opened.

The controller 86 includes a control block 92 connected to the brown line 89 and black line 90 for receiving power and to the yellow line 91 to receive the 24 volt command signal from the relay control 70. Relay coils R1C and R2C, associated with the relay contacts R1S and R2S, respectively, are connected between the control block 92 and the black common line 90 for selectively operating the relays R1 and R2. Likewise, an indicator light L1 is connected between the control block 92 and the common line 90. The thermostat 34 comprises a single pole double throw (SPDT) thermostat and includes the common terminal 44 connected to the orange line 91 via the conductor 48, the normally closed contact terminal 46 connected via the line 50 to the control block 92, and the normally open contact terminal 45 connected via the line 49 to the control block 92. A reset switch S1 is connected between the brown line 89 and the control block 92.

In accordance with the invention, the control block 92 comprises a microcontroller, such as a programmed processor and associated memory for operating in accordance with a control program to control operation of the vent proving system 22. Operation of the control program is as described below. Alternatively, the control block 92 could be implemented using firmware or hard wired logic circuitry for performing the same functionality as the programmed processor.

The sequence of operation of the program begins in a standby state with the command signal on the orange line 91 low. The relay coils R1C and R2C are deenergized. When the orange line 91 goes high the program starts a 5 minute delay timer and energizes the relay coils R1C and R2C. This closes the contacts R1S and R2S. The delay time could be a different length of time. After 5 minutes, the program determines if the thermostat NO contact is now closed, indicating a sufficiently high vent temperature. If so, then the relay coils R1C and R2C remain energized. If not, or if the sensed vent temperature later drops, representing a back draft condition, then the program deenergizes the relay coils R1C and R2C to open the contacts R1S and R2S and close the damper and shut off the burner. A fault condition flag is then set and the indicator L1 is illuminated until reset by the reset switch S1. A three hour timer is started by the program to provide a lockout state. The lockout state ends if the command signal on the line 91 is removed or after a three hour delay. After the three hour delay the program will repeat the operating cycle discussed above. Anytime the command signal on the command line 91 is removed the program returns to the standby state.

Conventional operation of boiler 10 is first described ignoring operation of the vent proving system 22 (assuming that it is not present). This operation is controlled by the relay control 70 in a conventional manner. If the room thermostat 78 calls for heat, then the relay control 70 energizes the circulating pump 80. This moves water from the boiler 10 to the appropriate zone. The relay control 70 includes a thermostat (not shown) for sensing water temperature. If water temperature is below a given set point, then the relay control applies power to the B1 terminal to provide a 24 volt command signal on the orange line to the vent damper 16. This causes the vent damper 16 to open. Once the vent damper 16 is open, then the 24 volt signal is returned on the yellow line to the pilot module 74. The pilot module 74 operates as an ignition control to provide a spark in connection with opening the gas valve 76. This ignites the burner 72. Once the water temperature exceeds the set point, then the 24 volt command signal is removed from the terminal B1 of the relay control 70 which in turn causes the vent damper 16 to close which in turn removes the ignition power on the yellow line to the pilot module 74 to turn off the gas burner 72. The closing of the vent damper 16 retains latent heat in the boiler 10, as is known.

The operation of the boiler 10 with the vent proving system 22 is now described. Particularly, the vent proving system 22 is connected in series between the boiler 10 and the damper 16, as discussed above. As noted, direct connections are provided, except for the orange line 91 which includes the two normally open relay contacts R1S and R2S associated with the corresponding relay coils R1C and R2C. The vent proving system 22 is a device intended to monitor the vent gas temperature from the boiler 10 to ensure the boiler 10 is venting properly. The control board 52 provides an interface between the SPDT thermostat 34, the relay control 70 of the gas fired boiler 10 and the automatic vent damper 16. The control board 52 incorporates time delay functionality which monitors the status of the thermostat 34 relative to the presence of a 24 volt command signal from the boiler 10 and operates redundant relays R1 and R2 to signal the vent damper 16 accordingly. The control board 52 also incorporates an indicator light L1 with a manual reset switch S1 to indicate if the vent proving system 22 has detected that a backdraft condition has been detected during the call for heat (excluding the first five minutes), meaning that improper venting has occurred.

If the boiler 10 is in a standby mode, then the vent proving system 22 is likewise in standby mode and the vent damper 16 is in the closed position. When the control block 92 receives a call for heat on the orange line 91, then the control block 92 starts the 5 minute timer. The relay contacts R1S and R2S close sending the 24 volt command signal on the orange line 91 to the vent damper 16. The vent damper 16 should prove open in about 15 seconds and send the 24 volt return signal back to the vent proving system 22 on the yellow line 88 and to the boiler 10 to operate the burner 72, as described above. The boiler 10 fires its main burner 72 and its products of combustion heat up the thermostat 34 causing it to actuate as sensed by the thermostat 34 switching to provide connection between the terminals 44 and 45 to the control block 92. The control block 92 in response to sensing the high signal on the terminal 45 holds in the relay coils R1C and R2C when the time delay expires. Once the boiler 10 satisfies the call for heat and removes the 24 volt signal on the orange line 91 then the damper 16 is closed, as discussed above, the gas burner 72 is turned off, the internal timers of the control 92 reset and the relay coils R1C and R2C are de-energized to open the contacts R1S and R2S.

If, on the other hand, the products of combustion do not heat up the thermostat 34 during the five minute delay implemented by the control 92, then the thermostat 34 remains in its normal state with connection between the terminals 44 and 46. The fact that the temperature in the vent 18 has not reached the necessary temperature represents a condition in which the air flow direction in the vent 18 comprises a back draft condition. Thus, when the five minute time delay expires and the temperature has not been satisfied, then the control block 92 deenergizes the relays R1 and R2 to open the relay contacts R1S and R2S removing the command signal to the damper 16 on the orange line 91. This in turn removes the return signal on the yellow line 88 back to the boiler 10 to turn off the gas burner 72. The vent damper 16 closes and the boiler 10 will shut off its burner 72 even though the relay control 70 is still sending a command signal to the vent proving system 22. Thereafter, the control block 92 includes the three hour time delay comprising the lockout state, discussed above. During this three hour time delay, further operation is prevented unless the thermostat 34 is cycled. The indicator L1 flashes until the reset switch S1 is manually reset.

Once the three hour time delay expires, then the sequence of operation is repeated as discussed above, until venting is proven or the control relay 70 removes the signal on the orange line 91 to the vent proving system 22.

As will be apparent, the vent proving system 22 monitors vent gas temperature continuously and if it falls below the set point after the five minute delay to break has expired, then the control block 92 will shut off the appliance main gas burner 72 even though the boiler 10 may have been venting properly initially. In the illustrated embodiment of the invention, the thermostat terminals 45 and 46 are directly connected to the control block 92. As will be apparent, the terminal 45 could be connected to the high side of the relay coils R1C and R2C to directly operate the relays R1 and R2 responsive to the vent proving having been satisfied.

Thus, in accordance with the invention, the controller 86 determines if a back draft condition is present in the vent 18 when the gas burner 72 is ignited and selectively operates the relays R1 and R2 to open the electrical switch contacts of the relays R1 and R2 to open the connection between the relay control 70 and the vent damper 16 if a back draft condition is present, represented by vent air temperature, when the gas burner is ignited.

Figure 6:
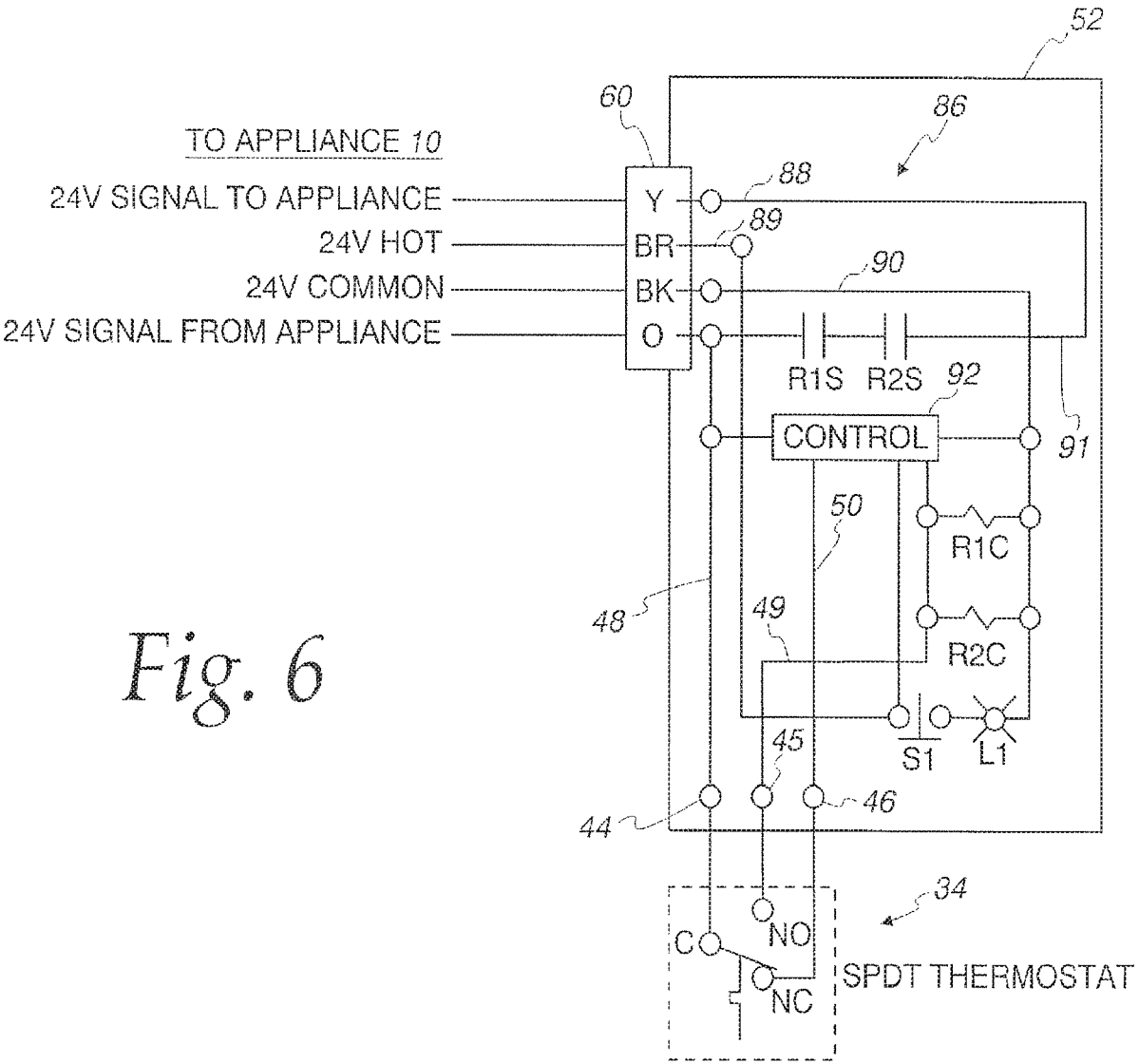
FIG. 6 is a detailed block diagram for the vent proving system of FIG. 2 without a damper.

The vent proving system 22 is described above in an installation in which a vent damper 16 is present. The vent damper 16 typically used for efficiency. The damper is not generally used with furnaces. FIG. 6 is a block diagram similar to FIG. 5 for the controller 86 on the control board 52 when a damper is not present. The principal difference is that the relay contacts R1S and R2S are connected in series between the orange line 91 and the yellow line 88 of the cable 60. This could alternatively be accomplished by jumpering the orange and yellow terminals of the connector 64, see FIG. 5, and ignoring the vent damper connections. This circuitry effectively provides a signal to the relay control 70 corresponding to the condition that the damper vent is open. The vent proving system 22 operates as described above, ignoring operation of the vent damper.

Particularly, if the boiler 10 is in a standby mode, then the vent proving system 22 is likewise in standby mode. When the control block 92 receives a call for heat on the orange line 91, then the control block 92 starts the 5 minute timer. The relay contacts R1S and R2S close sending the 24 volt command signal on the orange line 91 back to the yellow line 88 and to the boiler 10 to operate the burner 72, as described above. The boiler 10 fires its main burner 72 and its products of combustion heat up the thermostat 34 causing it to actuate as sensed by the thermostat 34 switching to provide connection between the terminals 44 and 45 to the control block 92. The control block 92 in response to sensing the high signal on the terminal 45 holds in the relay coils R1C and R2C when the time delay expires. Once the boiler 10 satisfies the call for heat and removes the 24 volt signal on the orange line 91, the gas burner 72 is turned off, the internal timers of the control 92 reset and the relays R1 and R2 are de-energized to open the contacts R1S and R2S.

If, on the other hand, the products of combustion do not heat up the thermostat 34 during the five minute delay implemented by the control 92, or thereafter, then the thermostat 34 will be in its normal state with connection between the terminals 44 and 46. The fact that the temperature in the vent 18 has not satisfied the necessary temperature represents a condition in which the air flow direction in the vent 18 comprises a back draft condition. Thus, after the five minute time delay expires and the temperature is not satisfied, then the control block 92 deenergizes the relay coils R1C and R2C to open the relay contacts R1S and R2S removing the command signal on the yellow line 88 back to the boiler 10 to turn off the gas burner 72. The boiler 10 will shut off its burner 72 even though the relay control 70 is still sending a command signal to the vent proving system 22.

Figure 7:
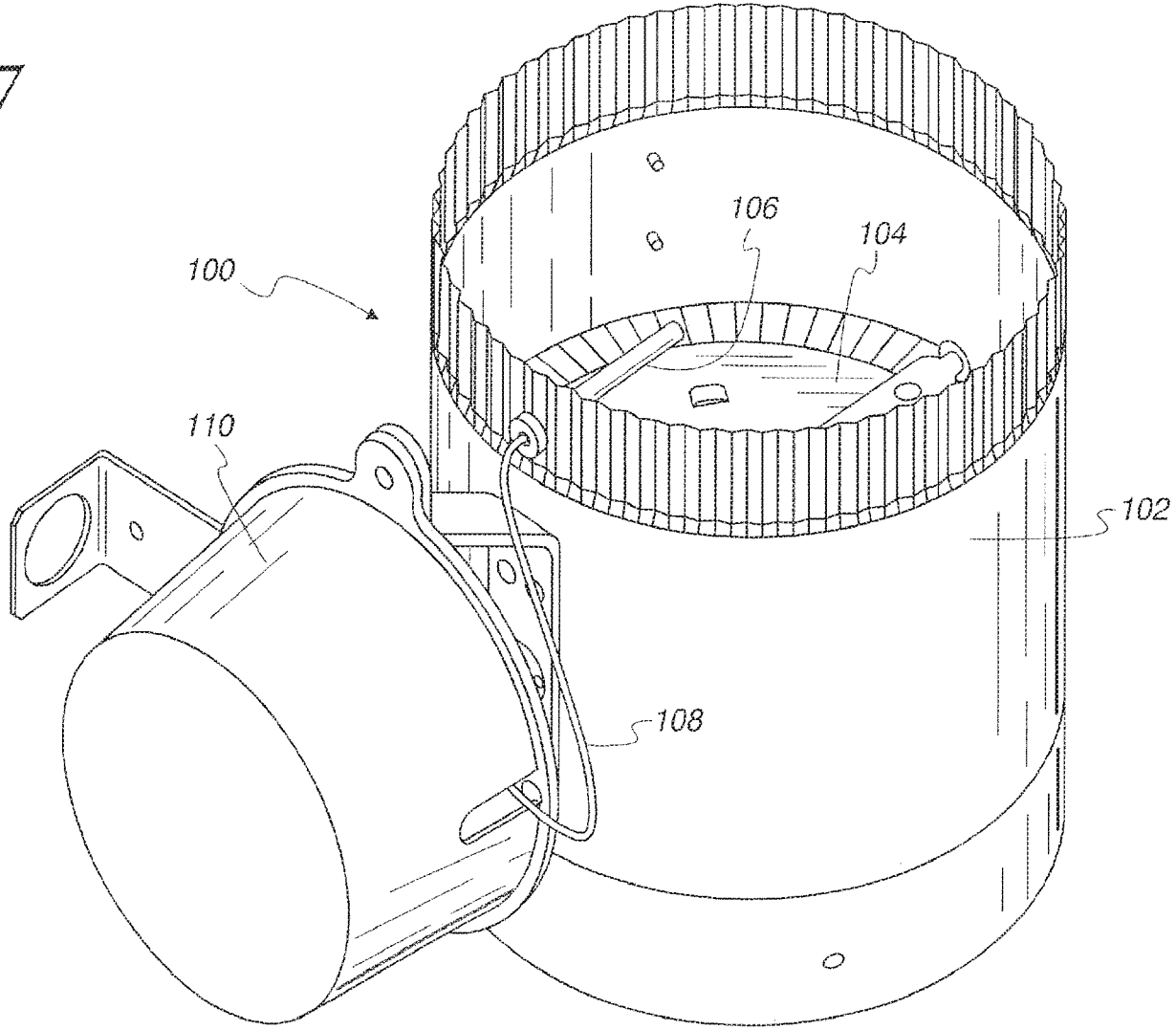
FIG. 7 is a perspective view of the vent proving system integral with a vent damper.
Figure 8:
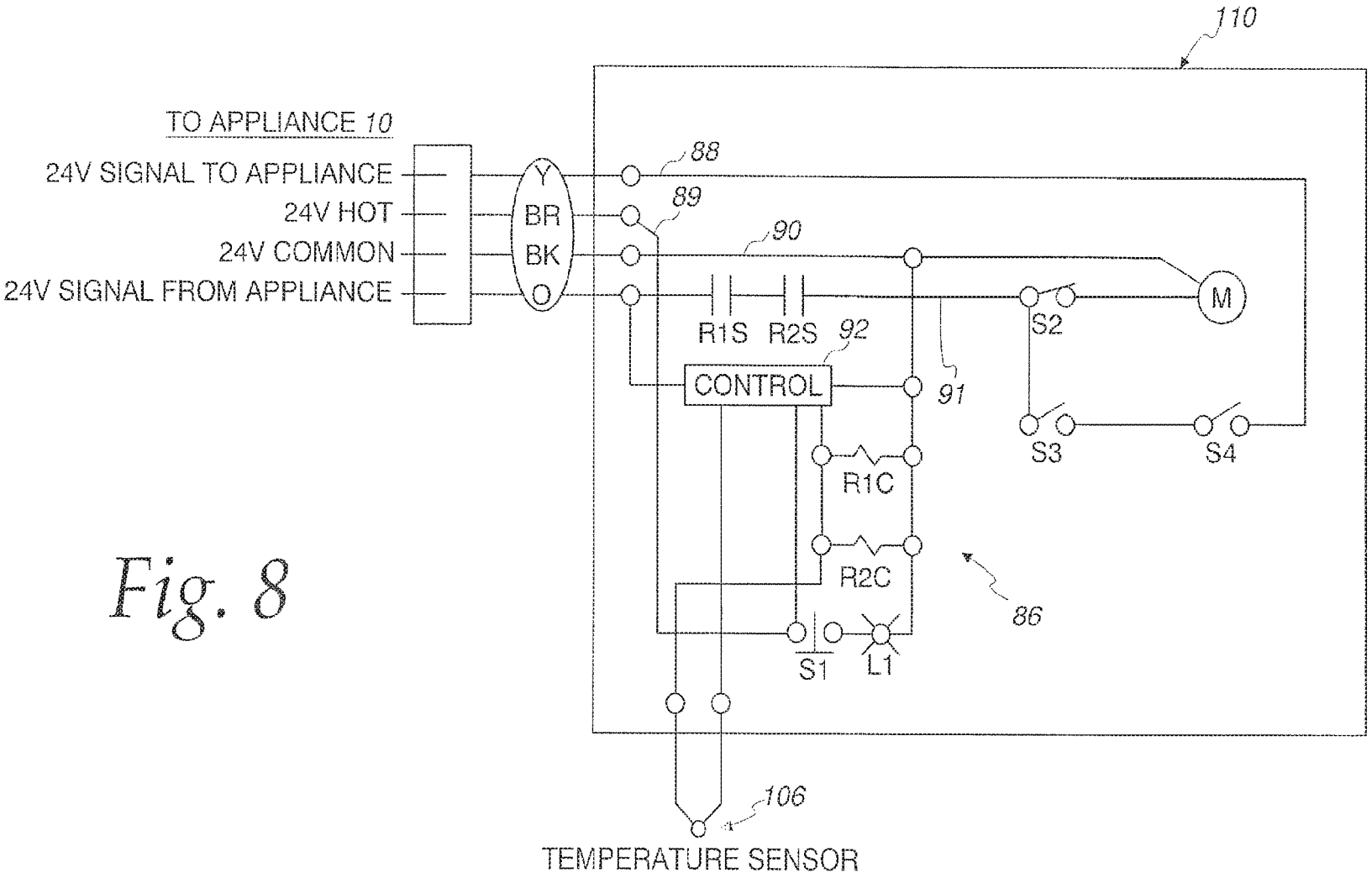
FIG. 8 is a detailed block diagram for the integral vent proving system and damper of FIG. 7.

Referring to FIG. 7, a vent proving system 100 is illustrated integral with a vent damper. Particularly, a cylindrical duct 102 pivotally supports a damper 104, as is conventional. The damper 104 is driven by a motor M, see FIG. 8. A temperature sensor 106 extends into the duct 102 and is connected by a wire 108 to the controller 82, see FIG. 8, in a housing 110 secured to the duct 102 by a bracket 112.

The controller 82 directly operates the motor M. The motor circuit includes limit switches S2, S3 and S4 operatively associated with the damper 104, as is conventional with vent dampers. The switch S2 is normally closed and opens when the damper 104 opens or closes. The switches S3 and S4 are closed if the damper is open and otherwise are closed. The switch S2 is connected in series in the orange line 91. The motor M is connected across the lines 90 and 91. The switches S3 and S4 are connected in series between the orange line 91 and the yellow line 88.

The temperature sensor 106 comprises a thermocouple. As is apparent, a thermistor or thermostat could also be used.

Operation of the controller 82 is as described above relative to FIG. 5.

The present invention has been described with respect to a program sequence of operation and block diagrams. It will be understood that each step of the sequence and block of the block diagrams can be implemented by computer program instructions. These program instructions may be provided to a processor to produce a machine, such that the instructions which execute on the processor create means for implementing the functions specified in the steps and/or blocks. The computer program instructions may be executed by a processor to cause a series of operational steps to be performed by the processor to produce a computer implemented process such that the instructions which execute on the processor provide steps for implementing the functions specified. Accordingly, the description and illustrations support combinations of means for performing a specified function and combinations of steps for performing the specified functions. It will also be understood that each block and combination of blocks can be implemented by special purpose hardware-based systems which perform the specified functions or steps, or combinations of special purpose hardware and computer instructions.

I claim:

1. A vent proving system for use with a gas fired appliance including a gas burner, a vent damper for selectively opening or closing an exhaust vent from the gas fired appliance and a relay control for operatively controlling the vent damper and the gas burner to open the damper if the gas burner is on, the vent proving system comprising:

a housing for mounting to the vent;

a control board in the housing including a first connection means for connection to the gas fired appliance and a second connection means for connection to the vent damper;

a thermostat secured to the housing and including a sensing probe protruding into the vent for sensing temperature in the vent;

an electrical switch in the housing connected between the first connection means and the second connection means for connection in series between the relay control and the vent damper; and a controller on the control board operatively connected to the sensor, the electrical switch and to the first connection means and the second connection means, the controller determining if a back draft condition is present in the vent when the gas burner is on and selectively operating the electrical switch to open the connection between the relay control and the vent damper if a back draft condition is present in the vent when the gas burner is on.

2. The vent proving system of claim 1 wherein the electrical switch comprises a relay operated by the controller and having a contact in series between the relay control and the vent damper.

3. The vent proving system of claim 2 wherein the relay comprises a first relay and further comprising a second relay operated by the controller and having a second relay contact in series with the first relay contact between the relay control and the vent damper.

4. The vent proving system of claim 1 wherein the controller includes a timer for operating the electrical switch to close the connection between the relay control and the vent damper for a select time after the relay control ignites the gas burner and after the select time operating the electrical switch to open the connection between the relay control and the vent damper if a back draft condition is present in the vent while the gas burner is on.

5. The vent proving system of claim 1 further comprising an indicator to indicate if a back draft condition has been sensed.

6. The vent proving system of claim 1 wherein the controller includes a timer for disabling operation of the electrical switch after a back draft condition has been sensed.

7. The vent proving system of claim 1 wherein the controller includes a timer for retrying operation of the electrical switch after a back draft condition has been sensed to determine if the back draft condition has been corrected.

8. The vent proving system of claim 1 wherein the vent proving system is integral with the vent damper and comprising a duct mounting a damper and the sensor.

* * * * *